US006131873A

United States Patent [19]

Blazon et al.

[11] Patent Number: 6,131,873

[45] Date of Patent: Oct. 17, 2000

[54] ENERGY ABSORBING HIGH IMPACT CABLE DEVICE

[76] Inventors: Fred R. Blazon, 1713 Rd. #28, El Vado, N. Mex. 07575; Robert Bookwater, 144 E. San Mateo, Santa Fe, N. Mex. 07500

[21] Appl. No.: 09/222,893

[22] Filed: Dec. 30, 1998

[51] Int. Cl.[7] ..... F16M 13/00; A47F 7/14; B60T 11/00

[52] U.S. Cl. ..... 248/548; 248/900; 188/372

[58] Field of Search ..... 248/548, 560, 248/499, 500, 900; 52/155; 188/372

[56] References Cited

U.S. PATENT DOCUMENTS

| | | | |
|---|---|---|---|
| 3,380,557 | 4/1968 | Peterson . | |
| 3,553,345 | 1/1971 | Edwards | 174/42 |
| 3,917,030 | 11/1975 | Morley et al. . | |
| 4,427,033 | 1/1984 | Ege . | |
| 4,530,205 | 7/1985 | Seiler et al. . | |
| 4,760,991 | 8/1988 | Asai | 254/134.3 |
| 5,207,302 | 5/1993 | Popp et al. | 188/372 |
| 5,321,922 | 6/1994 | Popp et al. | 52/155 |
| 5,332,071 | 7/1994 | Duncan . | |
| 5,340,152 | 8/1994 | Fohl . | |
| 5,433,290 | 7/1995 | Ellis et al. . | |
| 5,535,861 | 7/1996 | Ypung . | |
| 5,597,017 | 1/1997 | Eicher et al. . | |
| 5,669,214 | 9/1997 | Kopanakis . | |

FOREIGN PATENT DOCUMENTS

| | | |
|---|---|---|
| 610631 | 4/1979 | Switzerland . |
| 659299 | 1/1987 | Switzerland . |

*Primary Examiner*—Derek J. Berger
*Assistant Examiner*—David Heisey
*Attorney, Agent, or Firm*—Richard C. Litman

[57] ABSTRACT

An energy absorbing high impact cable device having a ring damper with first and second ends for attachment to at least one mesh net panel. The damper further includes a retainer for retaining the first and second ends, and to maintain a circular damper according to a predetermined stiffness for impact restraint. The ring damper further includes a cover, which is hermetically sealed around the cable to prevent degradation. A cable-to-loop fastener mechanically secures the cable device to at least one mesh net panel to form a linked arrangement. This particular arrangement translates absorbed energy within a plane of the panels to prevent structural deformation within the device due to rolling rock energies beyond a predetermined magnitude.

6 Claims, 8 Drawing Sheets

ENERGY ABSORBING HIGH IMPACT CABLE DEVICE

BACKGROUND OF THE INVENTION

1. Field of the Invention

The present invention relates generally to cables and support devices. More specifically, the invention is an energy absorbing high impact cable device which absorbs kinetic energy of rolling rocks upon impact within a rock fall net system.

2. Description of the Related Art

A variety of energy absorbing devices have been devised for minimizing shock or impact in a number of different application. Generally, the notion of shock absorbers have been relegated to use only in automobiles or similar vehicles for improving the comfort level of passengers, and reducing structural wear in the suspension systems of vehicles. This is a far cry to the use of such devices as herein described for applications involving rockfall fence systems.

Rock fall fence systems are used to protect motorists from rocks and boulders dislodged from slopes near roadways. Rocks and boulders can roll onto the road at high speeds carrying significant energy. There are many such rocks or boulders above and adjacent unprotected roadways here and abroad, that have caused fatalities and other damage. However, there has not yet been devised a cable device which absorbs large magnitudes of impact energy as herein described. While various devices have been developed for attenuating or absorbing shock induced impacts, these devices alone have been proven insufficient for preventing fatalities and great damage including structural deformation associated with rolling rocks and boulders.

For example, U.S. Pat. No. 3,380,557 issued to Peterson discloses a variable kinetic energy absorber comprising a piston and a cylindrical tube wherein a plurality of different plastic materials are used to minimize material deformation from a compressive force. The plastic materials are placed within the cylinder to give different resistive forces to extrusion at different positions of movement of the piston.

U.S. Pat. No. 3,553,345 issued to Edwards discloses a vibration damper comprising a wire conductor, a bell shaped damper which rests on the conductor, and is mechanically fastened thereto. A rod extends the length of the wire conductor and is in mating attachment between the conductor and damper. This particular damper is designed for overhead transmission line conductors, ground wires, guy wires, etc. for reducing eolian vibration and galloping or dancing wires.

U.S. Pat. No. 5,207,302 issued to Popp et al. discloses a shock absorbing tube used for rock wall fences in particular. The tube is bent to form a loop or ring with ends overlapping. A sleeve or clamp retains the form of the loop and allows the tube to slide therethrough while under tension. Another U.S. Patent issued to Popp et al. (U.S. Pat. No. 5,321,922) discloses a similar loop cable construction, except a plastic material extends completely around the cable and partially in the ground when the steel cable is used as an anchor for securing netting panels against falling rocks and avalanches. The following Foreign Patents and document(s) by Bollinger (CH 610 631), Enzler et al. (CH 659 299) and Cargnel (WO 87/00878), respectively teach similar loop like dampers as taught by Popp et al.

Other U.S. Patents disclosing shock absorbing mechanisms or devices are those by Duncan (U.S. Pat. No. 5,332,071), Fohl (U.S. Pat. No. 5,340,152), Ellis et al. (U.S. Pat. No. 5,433,290), Young (U.S. Pat. No. 5,535,861) and Eicher et al. (U.S. Pat. No. 5,597,017); these are directed to safety line cables. The safety cable taught by Duncan, in particular, comprises a cylindrical container having a spring like damper disposed therein. The cylinder plastically deforms under the impact load of a falling worker to indicate activation.

U.S. Patents issued to Morely et al. (U.S. Pat. No. 3,917,030), Ege (U.S. Pat. No. 4,530,205), Seiler et al. (U.S. Pat. No. 4,530,205), and Kopanakis (U.S. Pat. No. 5,669,214) are generally relevant to the energy absorbing high impact cable device according to the invention in that they disclose high energy absorbing articles and methods of making the same. The various materials disclosed in each referenced patent principally serve to limit stress propagation or bending strain.

None of the above inventions and patents, taken either singularly or in combination, is seen to describe the instant invention as claimed. Thus an energy absorbing high impact cable device solving the aforementioned problems is desired.

SUMMARY OF THE INVENTION

The energy absorbing high impact cable device according to the invention includes a ring damper with first and second ends for attachment to at least one mesh net panel. The damper further includes a retainer for retaining the first and second ends, and to maintain the configuration of the damper having a predetermined stiffness for impact restraint. The ring damper further includes a cover, which is hermetically sealed around the cable to prevent degradation. A loop to loop fastener arrangement is formed to mechanically secure the cable device to at least one mesh net panel. The cable device is also laterally linked to a respective mesh panel to translate absorbed impact energy within the plane of the panels to prevent structural deformation within the device due to rolling rock energies beyond a predetermined magnitude.

Accordingly, it is a principal object of the invention to provide an energy absorbing high impact cable device which attenuate rolling rock energies within rock fall net systems.

It is another object of the invention to provide an energy absorbing high impact cable device which absorbs energy of objects without plastic deformation.

It is a further object of the invention to provide an energy absorbing high impact cable device which attenuate absorbed energy laterally throughout a rock fall net structure to reduce deformation.

Still another object of the invention is to provide an energy absorbing high impact cable device which is impervious to weather erosion.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an energy absorbing high impact cable device for attenuating impact energies from rock falls. The preferred embodiments of the present invention are depicted in FIGS. 1–8, and is generally referenced by numeral 9.

Figure 1:
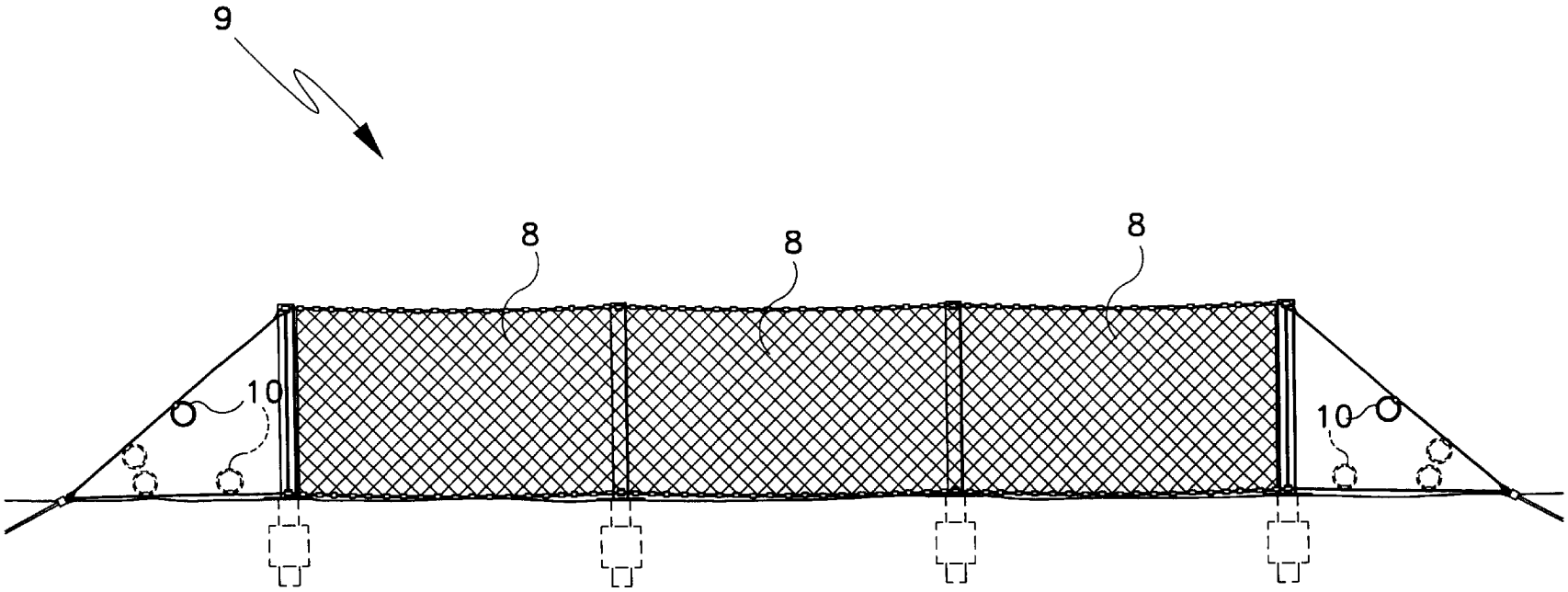
FIG. 1 is an environmental, perspective view of an energy absorbing high impact cable device and rockfall net system according to the present invention.
Figure 2:
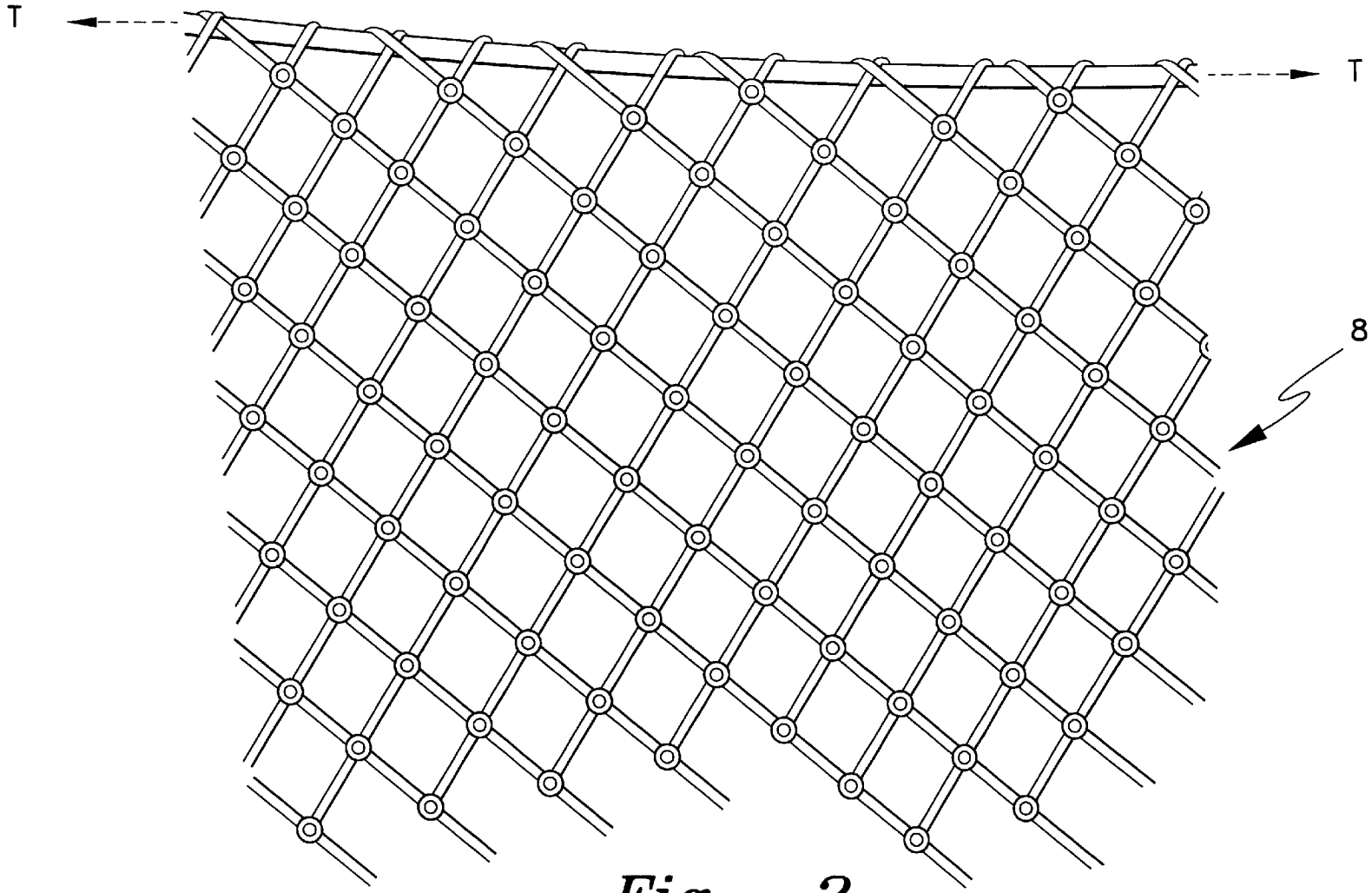
FIG. 2 is a partial perspective view of the energy absorbing high impact cable device and rockfall net system of FIG. 1.
Figure 3:
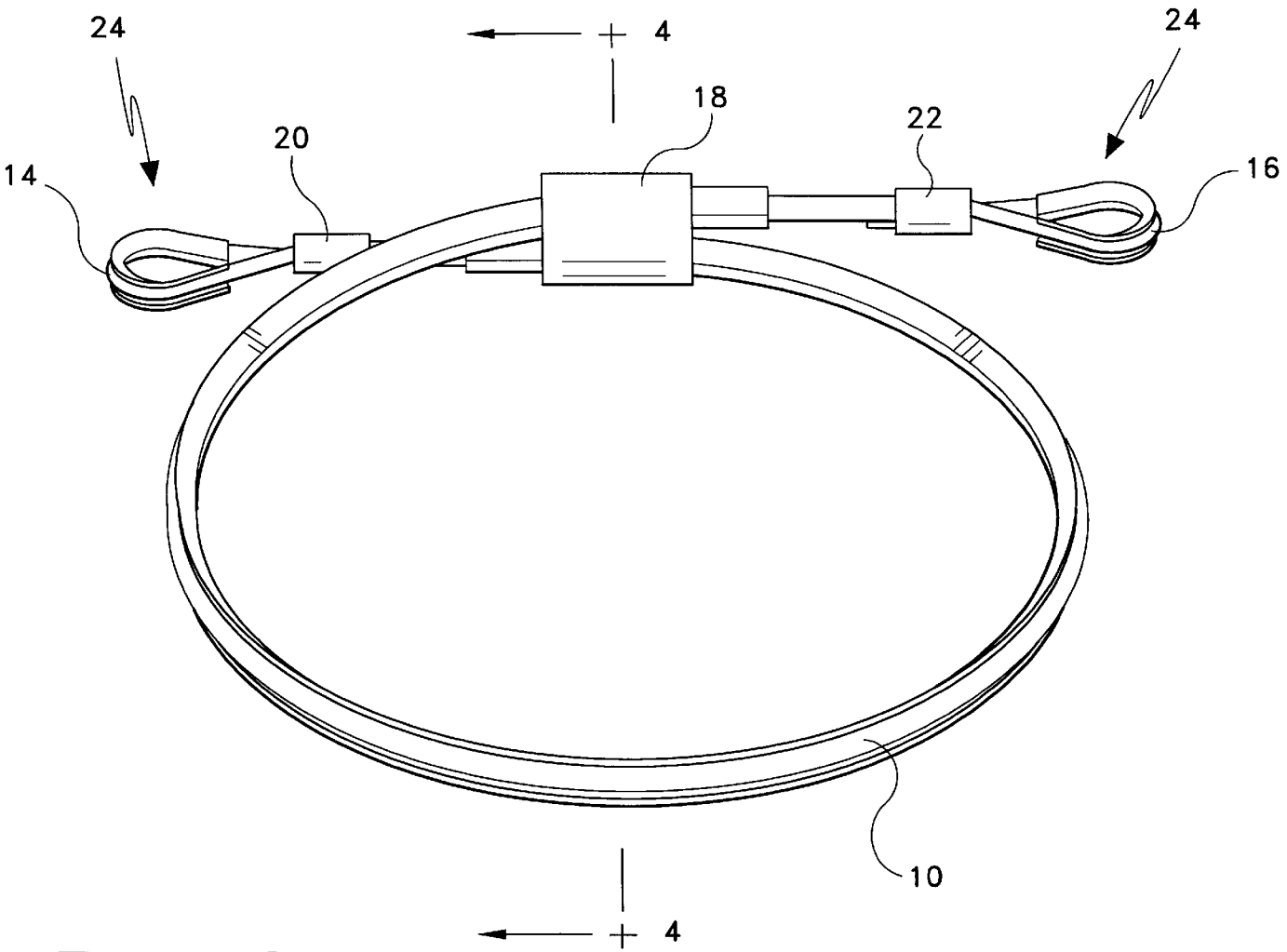
FIG. 3 is a top plan view of the energy absorbing high impact cable device according to a first embodiment of the invention.

As diagrammatically illustrated in FIGS. 1–2, the high energy absorbing impact cable device 9 is shown in combination with a a system of mesh net panels 8. As best shown in FIG. 3, a ring damper 10 with first and second ends 14 and 16 respectively is shown mechanically attached to at least one panel 8 in linked arrangement thereto according to one embodiment. According to a preferred embodiment, the damper 10 further includes a retainer means 18 for retaining the first and second ends 14,16 adjacent to and in abutment relation with at least one linked surface portion of the ring damper 10. The retainer means 18 by which the ends 14 and 16 are retained can include mechanical sleeves or channels which allows for movement between mating surfaces without degradation due to long term effects of surface friction or weather erosion.

Figure 4:
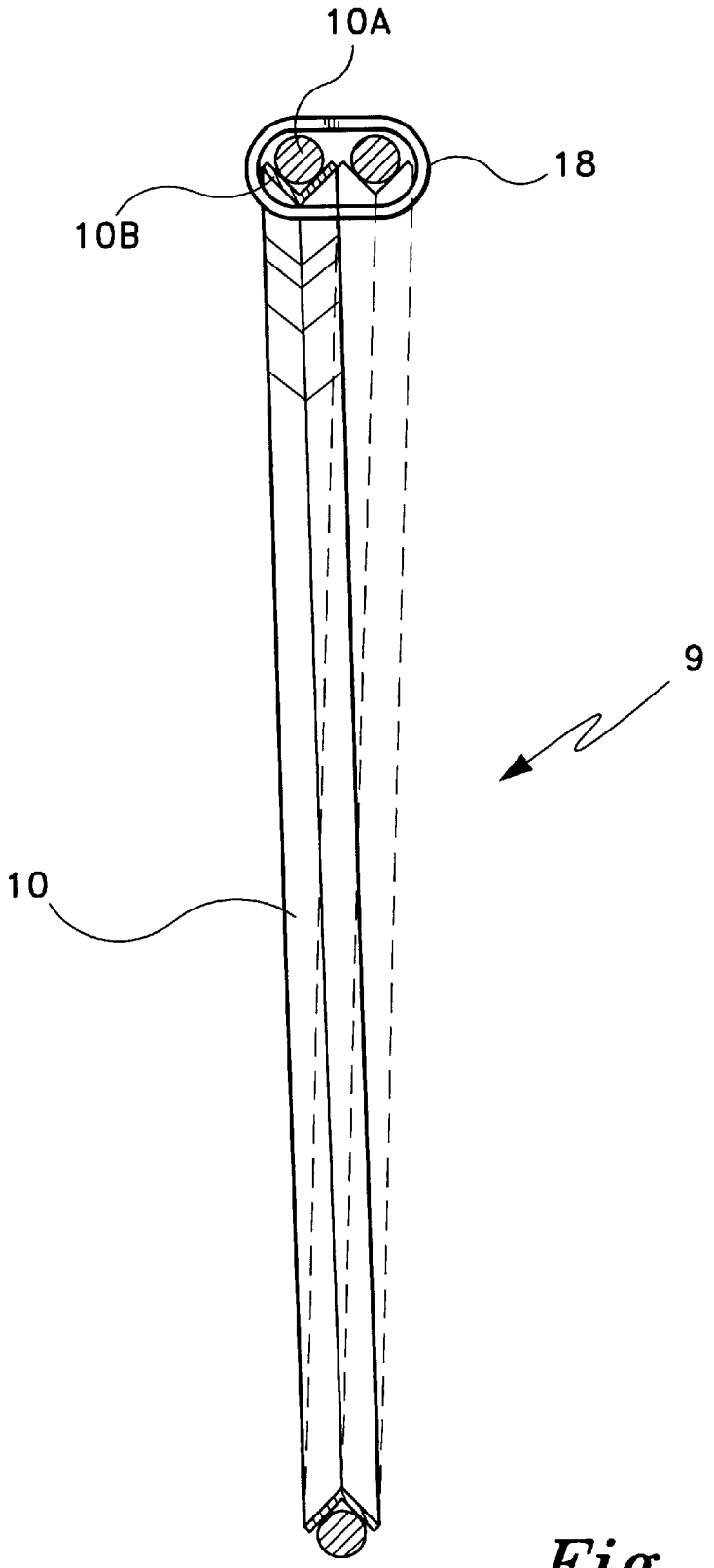
FIG. 4 is a sectional edge view of FIG. 3 along line 4—4 according to the first embodiment.

As best shown in FIGS. 3 and 4, the ring damper 10 further comprises a cable 10*a* having a predetermined stiffness which varies for diffeent materials, and a cover 10*b*. The cover 10*b* forms a hermetic seal around the cable to prevent further degradation from rusting due to moisture or similar environmental laden effects. A first and second fastening means 20 and 22 are used to fasten the first and second ends 14,16 of device 9 to either at least one mesh net panel or to form loop ends 24 as a single integrated unit without slippage. Any number of mechanical fasteners can be use so long as they are used within the scope and intent of the invention as herein disclosed.

Figure 5:
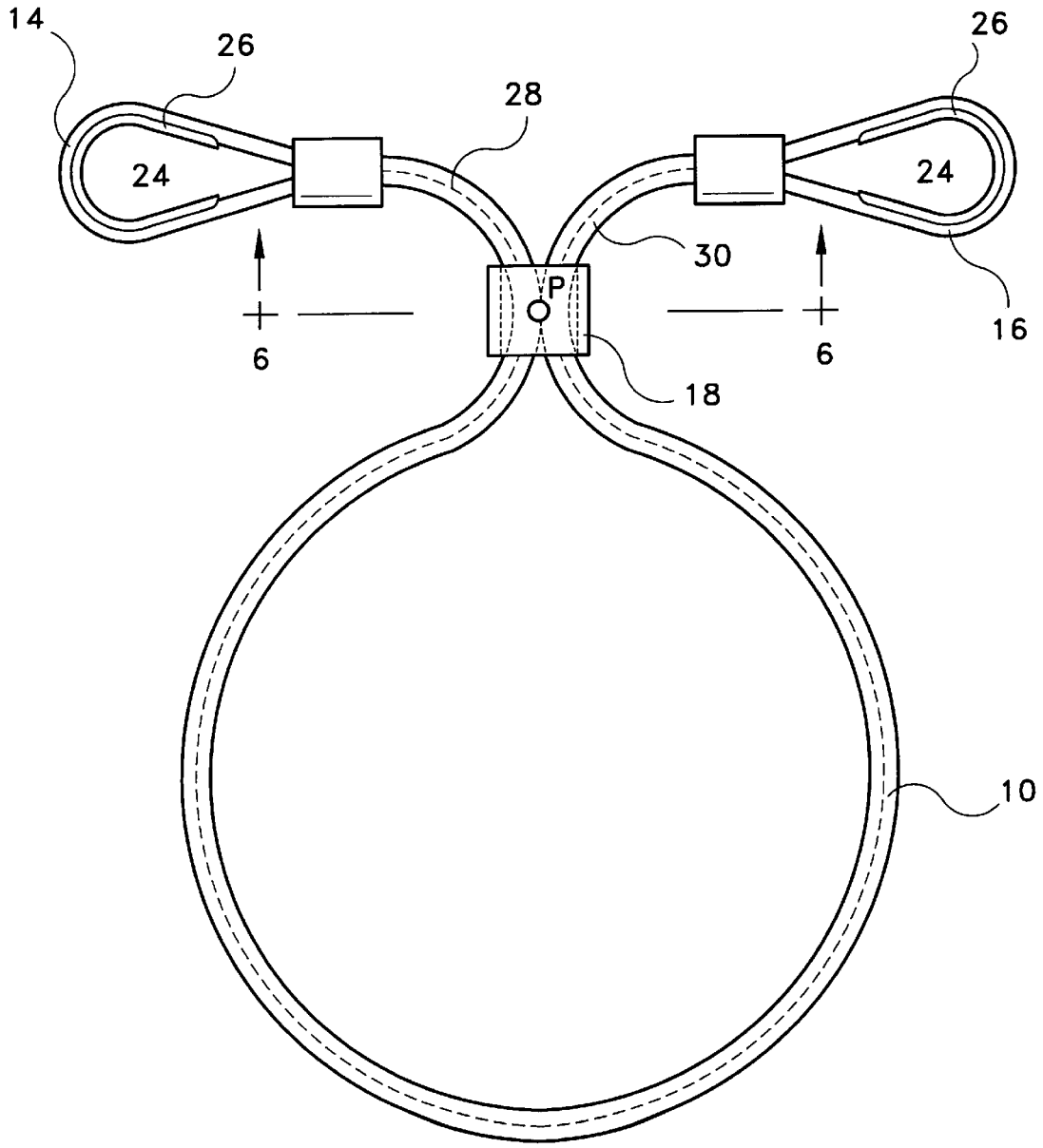
FIG. 5 is a top plan view of the energy absorbing high impact cable device according to a second embodiment of the invention.
Figure 6:
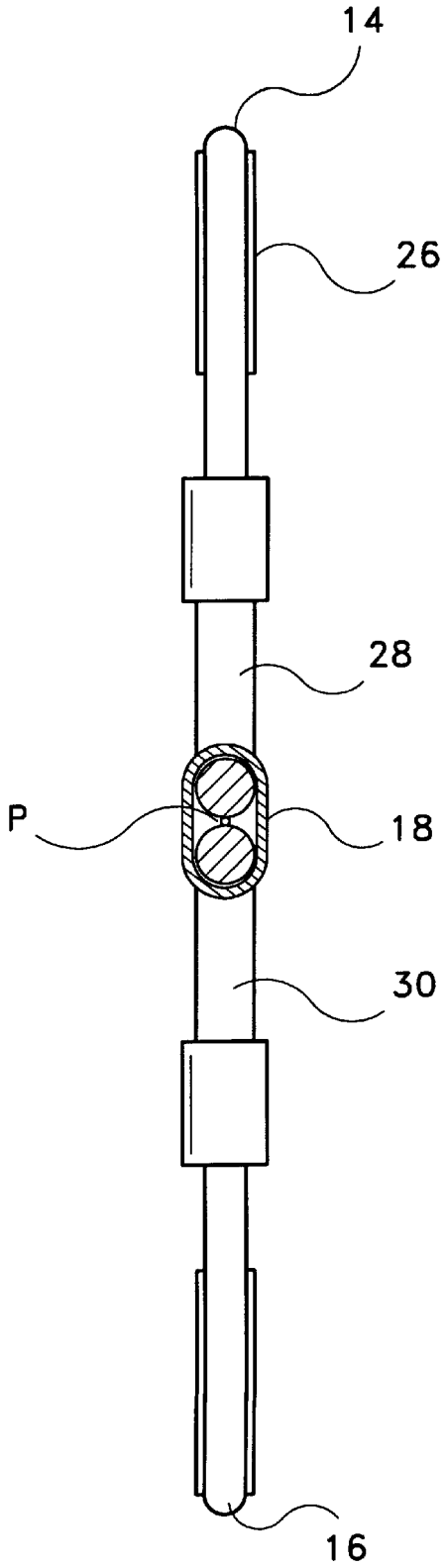
FIG. 6 is a sectional edge view of FIG. 5 along line 6—6 according to the second embodiment.
Figure 7:
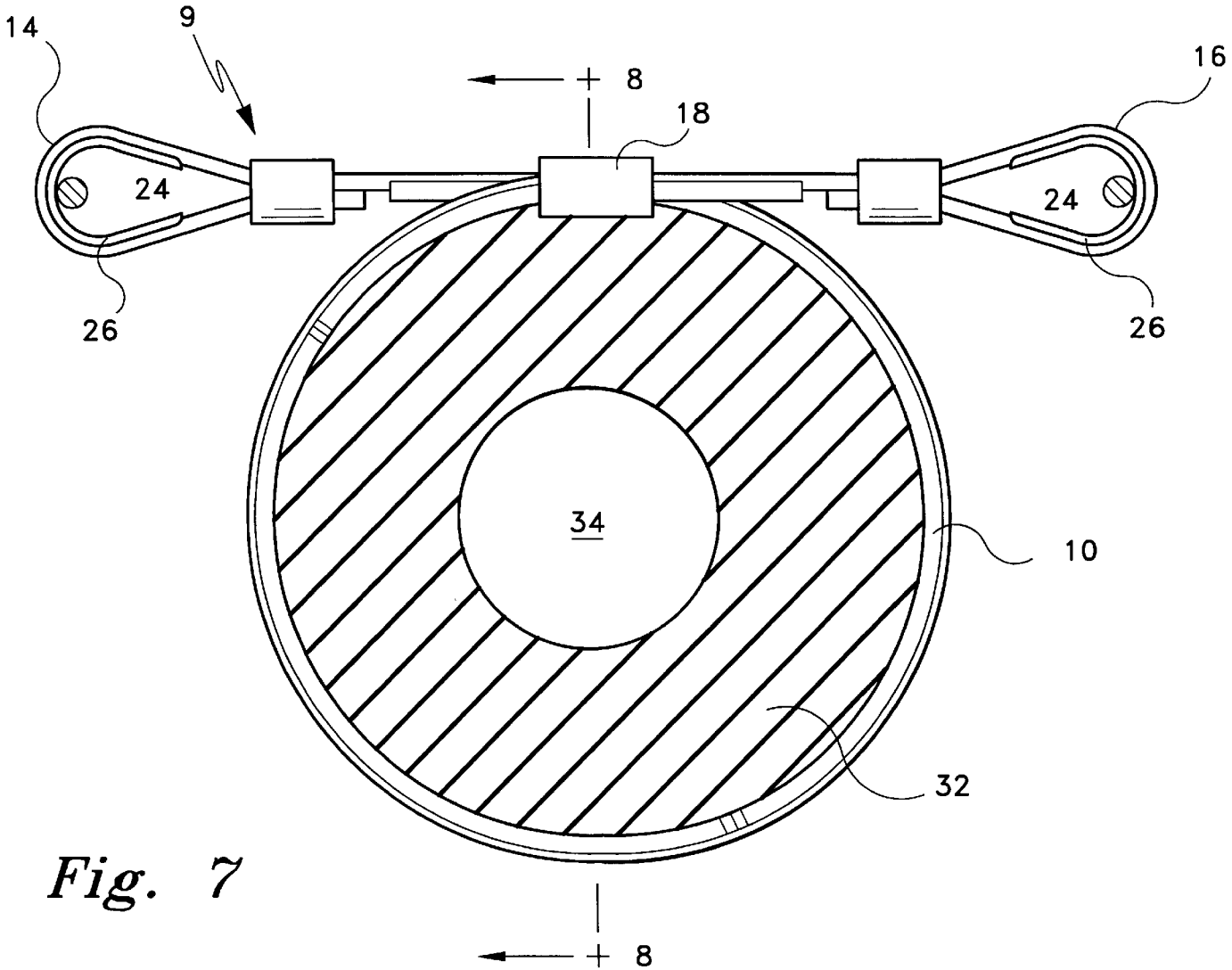
FIG. 7 is a top plan view of the energy absorbing high impact cable device according to a third embodiment of the invention.

As best seen in FIGS. 3, 5 and 7, the preferred configuration of the first and second ends 14 and 16 are looped ends 24. Each of the respective ends 14,16 further includes a material reinforcement layer 26 disposed within an internal region of each respective looped end 24. The material reinforcement layer 26 can be a heat fused or chemical bonded material laye. Depending on the preferred surface to surface configuration, the method of forming each reinforcement layer would vary. For metal to metal contact any available surface bonding technique can be used by the skilled artisan so long as the cable device 9 maintains the needed structural rigidity for high energy impacts ranging from around 80 ft-tons (217 kJ) to about 270 ft-tons (7322 kJ). As diagrammatically illustrated in FIG. 1, dual ring dampers 10 have been included in phantom as interconnected rings in both horizontal and diagonal cable arrangements to maintain the needed structural rigidity for higher energy impact at each end of the device 9.

According to a second embodiment, FIG. 5, diagrammatically illustrates the energy absorbing high impact cable device 9 wherein the ring damper 10 further comprises substantially first and second arcuate portions 28 and 30, respectively, which correspond to first and second ends 14,16. The first and arcuate portions 28,30 are formed in abutment relation within the remaining mean 18 and form arcs in opposite and counter lateral directions. This particular arrangement allows a uniform, but counter lateral load distribution throughout the device according to the instant invention. Thus, the arcuate portion 28 is directed to the left (lateral direction), and arcuate portion 30 is directed to the right (counter lateral direction) within a plane of each panel 8 thereby minimizing fatigue failure from concentrated loads at the central point P. (Refer also to sectional views FIGS. 4 and 6, respectively). Tensional forces T are directed laterally along the panel as indicated in FIG. 2.

Figure 8:
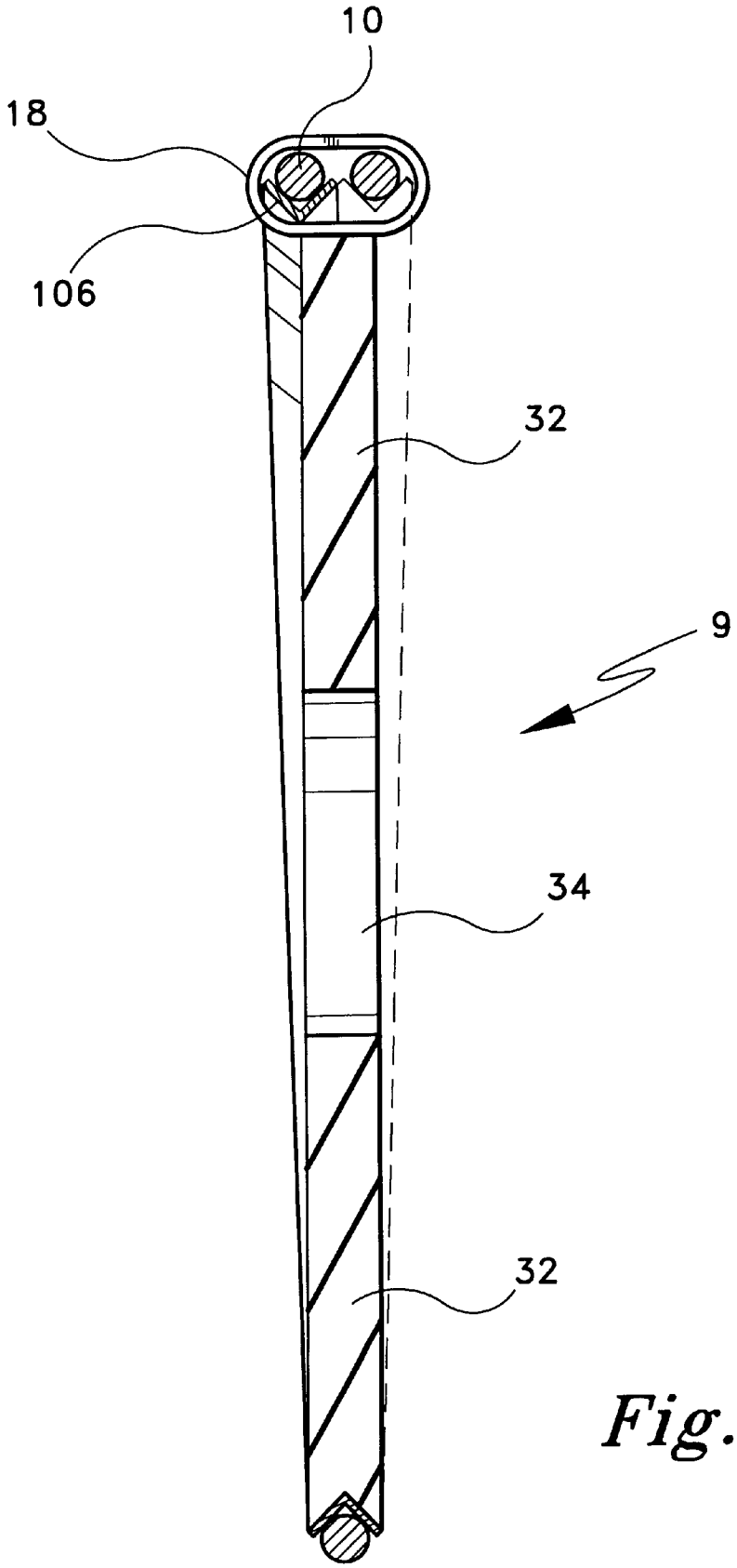
FIG. 8 is a sectional edge view of FIG. 7 along line 8—8 according to the third embodiment.

According to a third embodiment, FIG. 7, diagrammatically illustrates the energy absorbing high impact cable device 9, wherein the ring damper 10 further comprises an internal dampening material 32 for preventing plastic deformation. A central aperture 34 is disposed therein to reduce inertia and provide a certain level of dampening for various impact loads having a direct correlation with a predetermined impact energy magnitude. Figure 8 discloses a sectional view of the of the cable device 9 according to the third embodiment. The interior dampening material is similarly fused or bonded to the ring 10 as recited above.

Other notable advantages of the energy absorbing high impact cable device according to the invention are the particular use of weather resistant materials for reducing wear and/or degradation Additional features include surface coating techniques which also significantly reduces wear for cable materials such as iron stainless steel, braided cable or an aluminum alloy. With respect to dimensional qualities, it would be obvious to one of ordinary skill in the art to use a specific set of dimensional quantities to optimize the structural features for withstanding cyclical loads and stresses produced by various impact energies. The mesh net panels in particular are made of galvanized aircraft cable between 7×7 and 7×19 gac. This material has a tremendous breaking strength compared to conventional rope materials for absorbing high energy impact.

It is to be understood that the present invention is not limited to the embodiments described above, but encompasses any and all embodiments within the scope of the following claims.

We claim:

1. An energy absorbing high impact cable device comprising:

a ring damper having first and second ends for linked attachment to at least one mesh net panel, said damper further includes a retainer means for retaining said first and second ends adjacent to and in abutment relation with at least one extended surface portion of the ring damper, said ring damper further comprises a cable having a predetermined stiffness, an internal dampening material for preventing plastic deformation, and a cover, said cover is hermetically sealed around said cable to prevent degradation, and a first and second fastening means for fastening said first and second ends of said device to said at least one mesh net panel.

2. The energy absorbing high impact cable device according to claim 1, wherein said first and second ends are looped ends.

3. The energy absorbing high impact cable device according to claim 2, wherein said first and second looped ends further comprises a material reinforcement layer disposed within an internal region of the respective looped ends.

4. The energy absorbing high impact cable device according to claim 3, wherein said material reinforcement layer is a heat fused material layer.

5. The energy absorbing high impact cable device according to claim 1, wherein said ring damper further comprises substantially first and second arcuate portions corresponding to said first and second ends, said first and second arcuate portions are in abutment relation within the retaining means and form arcs in opposite and counter lateral directions.

6. The energy absorbing high impact cable device according to claim 1, wherein said ring damper further comprises a central aperture.

* * * * *